US011731439B2

(12) United States Patent
Fukasawa et al.

(10) Patent No.: US 11,731,439 B2
(45) Date of Patent: Aug. 22, 2023

(54) PRINTER

(71) Applicant: SEIKO EPSON CORPORATION, Tokyo (JP)

(72) Inventors: Koki Fukasawa, Shiojiri (JP); Tomosuke Gomi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 133 days.

(21) Appl. No.: 17/593,763

(22) PCT Filed: Nov. 29, 2019

(86) PCT No.: PCT/JP2019/046775
§ 371 (c)(1),
(2) Date: Sep. 24, 2021

(87) PCT Pub. No.: WO2020/194874
PCT Pub. Date: Oct. 1, 2020

(65) Prior Publication Data

US 2022/0184979 A1 Jun. 16, 2022

(30) Foreign Application Priority Data

Mar. 27, 2019 (JP) ..... 2019-060191

(51) Int. Cl.
*B41J 11/70* (2006.01)

(52) U.S. Cl.
CPC ..... *B41J 11/70* (2013.01)

(58) Field of Classification Search
CPC ... B41J 11/70; B41J 11/706; B41J 2/01; B41J 2/175; B41J 2/17509; B41J 29/13
USPC ..... 347/104
See application file for complete search history.

(56) References Cited

U.S. PATENT DOCUMENTS

2012/0140010 A1* 6/2012 Ogawa ..... B26D 1/045 347/104
2016/0339722 A1* 11/2016 Shimizu ..... B41J 2/17523

FOREIGN PATENT DOCUMENTS

| | | |
|---|---|---|
| JP | 2006-224555 | 8/2006 |
| JP | 2010-131893 A | 6/2010 |
| JP | 2011-161795 A | 8/2011 |
| JP | 2017-222035 A | 12/2017 |

* cited by examiner

*Primary Examiner* — Matthew Luu
*Assistant Examiner* — Alexander D Shenderov
(74) *Attorney, Agent, or Firm* — Workman Nydegger

(57) ABSTRACT

A printer includes: a first ink storage unit and a second ink storage unit; an ejection head; a carriage configured to move the ejection head and the second ink storage unit; a tube coupling the first and the second ink storage unit to each other; a first exterior member positioned in front of the carriage; and a cutter configured to move in a scanning direction between the carriage and the first exterior member, wherein an opening is formed in the first exterior member at a position in front of the cutter, an inner surface of the first exterior member includes a first slide contact surface with which the tube can be brought into slide contact, and the first slide contact surface is positioned in an opening region where the opening is formed in the scanning direction and in a region above the opening in a vertical direction.

6 Claims, 8 Drawing Sheets

PRINTER

TECHNICAL FIELD

The present disclosure relates to a printer.

BACKGROUND ART

For example, as disclosed in patent literature 1, there has been known a printer that performs recording on a recording sheet that is an example of a medium by ejecting ink from a recording head that is an example of an ejection head. The printer includes a carriage configured to move the recording head, a roller configured to transport the recording paper in a transport direction, and an ink tube that is an example of a tube for supplying ink to the recording head from an ink tank portion that is an example of a first ink storage unit. The ink tube is supported by a housing frame positioned downstream the carriage in the transport direction so as to prevent sagging of the ink tube due to its own weight.

CITATION LIST

Patent Literature

[PTL 1] JP-A-2010-131893

SUMMARY OF INVENTION

Technical Problem

Amongst printers, there has been known a printer where a medium on which recording is made is cut by a cutter, and the cut medium is discharged through a discharge port. In such a printer, an opening for maintenance of the cutter is formed in an exterior member in which the discharge port is formed. Accordingly, when a tube is supported by the exterior member, there is a concern that the tube is positioned between the opening and the cutter so that visibility of the cutter is obstructed.

Solution to Problem

To solve the above-mentioned drawback, a printer includes: a first ink storage unit configured to store ink, a second ink storage unit configured to store the ink supplied from the first ink storage unit, an ejection head configured to eject the ink toward a medium, a carriage configured to move the ejection head and the second ink storage unit in a scanning direction and a direction opposite to the scanning direction, a tube coupling the first ink storage unit and the second ink storage unit to each other, an exterior member positioned in front of the carriage, and a cutter configured to move in the scanning direction between the carriage and the exterior member to cut the medium, wherein in the exterior member, an opening is formed in front of the cutter disposed at a predetermined position, an inner surface of the exterior member includes a first slide contact surface with which the tube can be brought into slide contact, and the first slide contact surface is positioned in an opening region where the opening is formed in the scanning direction and in a region above the opening in a vertical direction.

DESCRIPTION OF EMBODIMENTS

Figure 1:
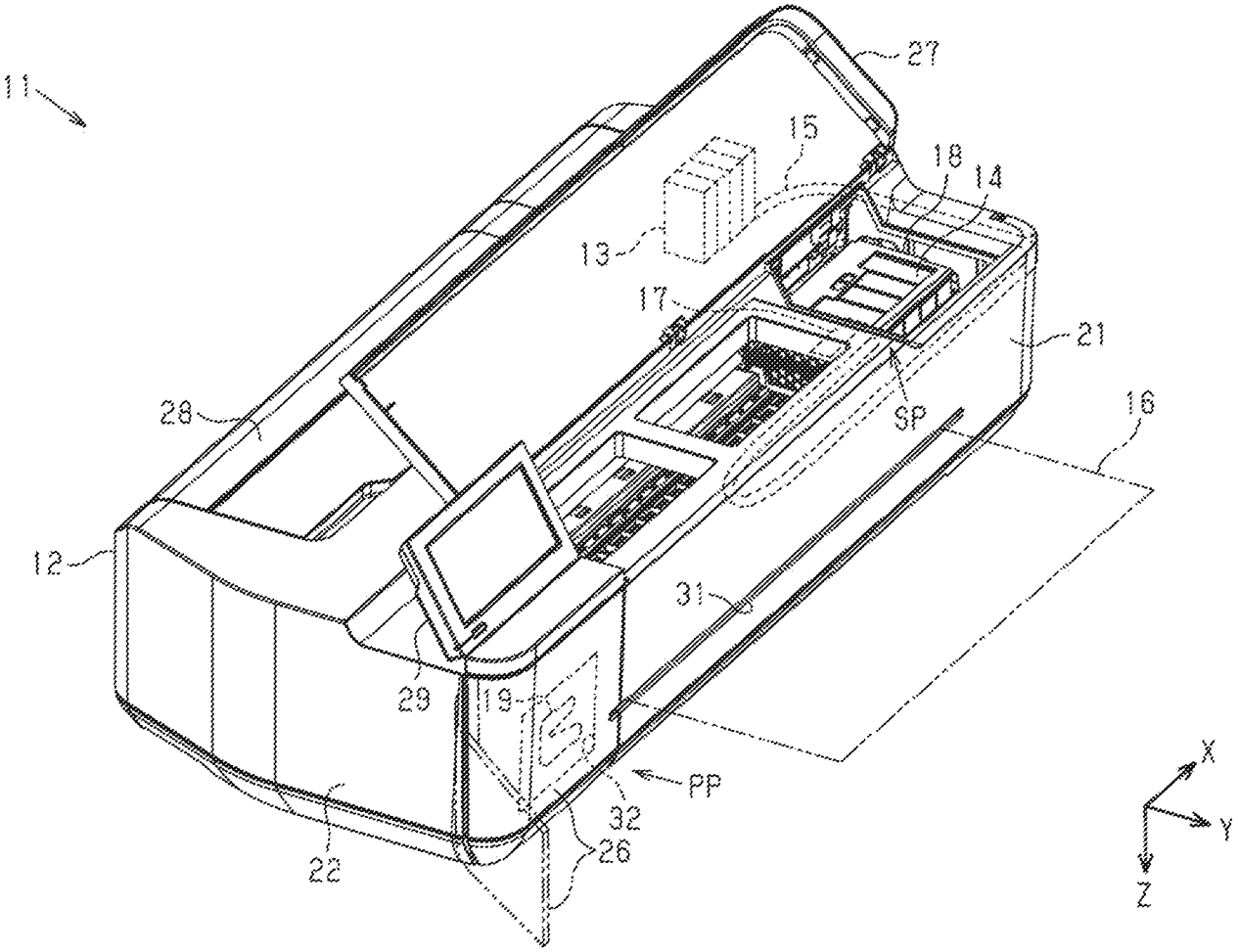
FIG. 1 is a perspective view of an embodiment of a printer.

Hereinafter, a printer according to an embodiment is described with reference to drawings. The printer is an ink jet-type printer configured to print a character and an image on a medium such as a sheet paper by ejecting ink.

In the drawings, assume a state where a printer 11 is placed on a horizontal surface, a direction of gravity is indicated by a Z axis, and directions along the horizontal surface are indicated by an X axis and a Y axis respectively. The X axis, the Y axis, and the Z axis are orthogonal to each other. In the following description, a direction along the X axis is also referred to as a scanning direction X, and a direction along the Y axis is also referred to as frontward direction, a direction opposite to the frontward direction is also referred to as a rearward direction, a direction along the Z axis is also referred to as a vertically downward direction, and a direction opposite to the vertically downward direction is also referred to as a vertically upward direction.

As illustrated in FIG. 1, the printer 11 includes a case 12 having a rectangular parallelepiped shape. The printer 11 includes a first ink storage unit 13 configured to store ink, a second ink storage unit 14 configured to store ink supplied from the first ink storage unit 13, and a tube 15 coupling the first ink storage unit 13 and the second ink storage unit 14 to each other. The printer 11 according to the present embodiment is a color printer including a plurality of sets each consisting of the first ink storage unit 13, the second ink storage unit 14, and the tube 15. The printer 11 performs printing using inks of plural colors. In the present embodiment, in order to simply illustrate a configuration of the printer 11, four first ink storage units 13, four second ink storage units 14, and four tubes 15 for supplying ink from the four first ink storage units 13 to the four second ink storage units 14 are collectively illustrated. The printer 11 may be a monochrome printer including a set of the first ink storage unit 13, the second ink storage unit 14, and the tube 15. FIG. 1 is not intended to limit the form of the plurality of tubes 15, and the plurality of tubes 15 may be configured to be grouped together, or the plurality of tubes 15 may be provided such that the plurality of tubes 15 are operated independently of each other. For example, the plurality of tubes 15 are grouped together by adhering portions of the tubes 15 to each other using an adhesive agent or by bundling portions of the tubes 15 together using a bundling band.

The first ink storage unit 13 may be disposed in the case 12 or may be disposed outside the case 12. The first ink storage unit 13 may be an exchangeable cartridge type storage unit or may be a tank type storage unit where ink is replenishable.

The printer 11 includes an ejection head 17 configured to eject ink toward a medium 16, a carriage 18 configured to move the ejection head 17 and the second ink storage unit 14 in the scanning direction X and in a direction opposite to the scanning direction X, and a cutter 19 configured to cut the medium 16. The cutter 19 moves in the scanning direction X from a predetermined position PP illustrated in FIG. 1, and cuts the medium 16. In the scanning direction X, a position on a side opposite to the predetermined position PP with respect to the medium 16 is assumed as a standby position SP of the carriage 18. The second ink storage unit 14, the ejection head 17, the carriage 18, and the cutter 19 are provided in the case 12.

Figure 2:
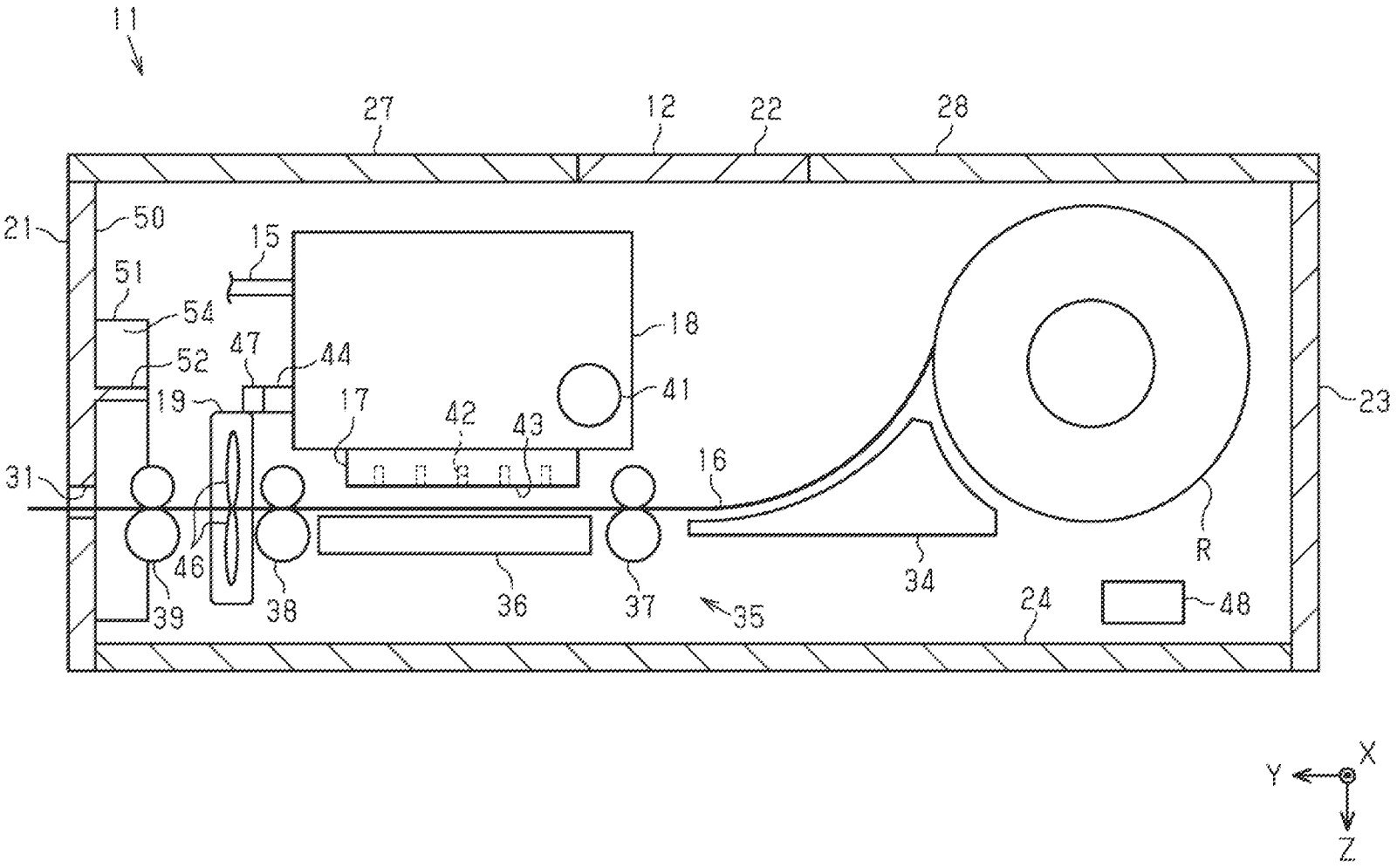
FIG. 2 is a schematic side view illustrating an internal configuration of the printer.

As illustrated in FIG. 1 and FIG. 2, the case 12 includes a first exterior member 21 that is an example of an exterior member positioned in front of the carriage 18. The first exterior member 21 covers a front side of the printer 11. The case 12 includes a second exterior member 22 that covers an upper side in a vertical direction and sides of the printer 11, a third exterior member 23 that covers a rear side of the printer 11, and a fourth exterior member 24 that covers a lower side in the vertical direction of the printer.

As illustrated in FIG. 1, a front cover 26 is mounted on the first exterior member 21. On the second exterior member 22, a first upper cover 27, a second upper cover 28, and an operation panel 29 are mounted.

In the first exterior member 21, a discharge port 31 through which the medium 16 on which printing is performed is discharged, and an opening 32 that is positioned in front of the cutter 19 at the predetermined position PP are formed adjacent to each other in the scanning direction X. The discharge port 31 is formed in a shape that makes foreign substances minimally enter the case 12 from the outside while allowing the discharging of the medium 16. In the present embodiment, the discharge port 31 has a slit shape with a small gap in the vertical direction. The opening 32 is formed larger than the cutter 19 in the scanning direction X and in the vertical direction. The predetermined position PP of the cutter 19 is the position at which exchanging or maintenance of the cutter 19 is can be performed through the opening 32.

The front cover 26 is rotated between a closed position indicated by a solid line in FIG. 1 and an open position indicated by a double-dashed chain line in FIG. 1 about an axis parallel to the Z axis. The front cover 26 positioned at the closed position covers the opening 32 and the cutter 19 from a front side. The front cover 26 positioned at the open position exposes the opening 32 and the cutter 19. When the front cover 26 is positioned at the open position, the opening 32 and the cutter 19 can be visually recognized from the outside.

The first upper cover 27, the second upper cover 28, and the operation panel 29 each have an axis parallel to the X axis and are rotatable about the axes thereof respectively. The first upper cover 27 is rotated between the open position illustrated in FIG. 1 and the closed position illustrated in FIG. 2. The first upper cover 27 is rotated about an axis positioned at a rear end of the first upper cover 27 positioned at the closed position. When the first upper cover 27 is positioned at the open position, a user can perform maintenance of the second ink storage unit 14, the medium 16 positioned at a printing position, and the like. The second upper cover 28 is rotated between the closed position illustrated in FIG. 1 and the open position not illustrated in the drawing. The second upper cover 28 is rotated about an axis positioned at a rear end of the second upper cover 28 positioned at the closed position. The user can load a roll body R illustrated in FIG. 2 formed by winding the medium 16 in a circular cylindrical shape in a space that is opened when the second upper cover 28 is at an open position. The operation panel 29 is rotated between a raised position illustrated in FIG. 1 and a tilted position at which the operation panel 29 is tilted rearward from the raised position. The operation panel 29 positioned at the upright position faces forward.

As illustrated in FIG. 2, the printer 11 includes a guide member 34 configured to guide the medium 16 fed from the roll body R, a transport unit 35 configured to transport the medium 16, and a support strut 36 configured to support the medium 16 transported by the transport unit 35. The transport unit 35 is configured to transport the medium 16 fed from the roll body R toward a downstream side in a transport direction. In the present embodiment, the transport direction is a direction that the medium 16 is transported along the members included in the printer 11, that is, the members including the guide member 34 and the support strut 36. The transport unit 35 includes a pair of transport rollers 37 provided between the guide member 34 and the support strut 36 in the transport direction, a pair of relay rollers 38 provided between the support strut 36 and a movement path of the cutter 19 in the transport direction, and a pair of discharge rollers 39 provided between the movement path of the cutter 19 and the discharge port 31 in the transport direction. The pair of transport rollers 37, the pair of relay rollers 38, and the pair of discharge rollers 39 transport the medium 16 by rotating in a state where the medium 16 is sandwiched between the pair of rollers.

The transport unit 35 transports the medium 16 fed from the roll body R toward a downstream side in the transport direction, and discharges the medium 16 from the discharge port 31 in a discharge direction. The discharge port 31 is positioned in front of the printing position at which the ejection head 17 performs printing on the medium 16. The transport unit 35 transports the medium 16 positioned at the printing position toward a front side, and discharges the medium 16 toward a front side from the discharge port 31. That is, the transport direction and the discharge direction at the printing position are aligned with the frontward direction.

The printer 11 includes a guide shaft 41 that supports the carriage 18. The ejection head 17 is mounted on the carriage 18 in a posture that a nozzle surface 43 on which nozzles 42 are formed faces the support strut 36 or the medium 16 supported by the support strut 36. The carriage 18 is movable along the guide shaft 41 in a reciprocating manner. A carriage coupling portion 44 to which the cutter 19 can be coupled is provided on a front surface that is a front-side surface of the carriage 18.

The cutter 19 includes two cutting blades 46 for cutting the medium 16, and a cutter coupling portion 47 coupled to the carriage coupling portion 44. The two cutting blades 46 each have a disk shape, and are attached in a rotatable manner with cutting edges thereof aligned to each other. The cutter 19 moves in the scanning direction X and the direction opposite to the scanning direction X along with movement of the carriage 18 in a state where the cutter 19 and the carriage 18 are coupled to each other. The cutter 19 moves in the scanning direction X between the carriage 18 and the first exterior member 21 to cut the medium 16.

The printer 11 includes a control unit 48 that comprehensively controls driving of respective mechanisms in the printer 11. The control unit 48 is constituted of a processing circuit and the like including a computer and a memory, for example. The control unit 48 controls various operations executed by the printer 11 in accordance with programs stored in the memory.

An inner surface 50 of the first exterior member 21 is a surface facing a rear side. The inner surface 50 of the first exterior member 21 includes a first slide contact surface 51 with which the tube 15 can be brought into slide contact. The inner surface 50 of the first exterior member 21 may include a second slide contact surface 52 with which the tube 15 can be brought into slide contact. The first slide contact surface 51 and the second slide contact surface 52 of the present embodiment are horizontal surfaces, and support the tube 15, from below in the vertical direction, that is brought into slide contact with the first and second slide contact surfaces 51, 52.

Figure 3:
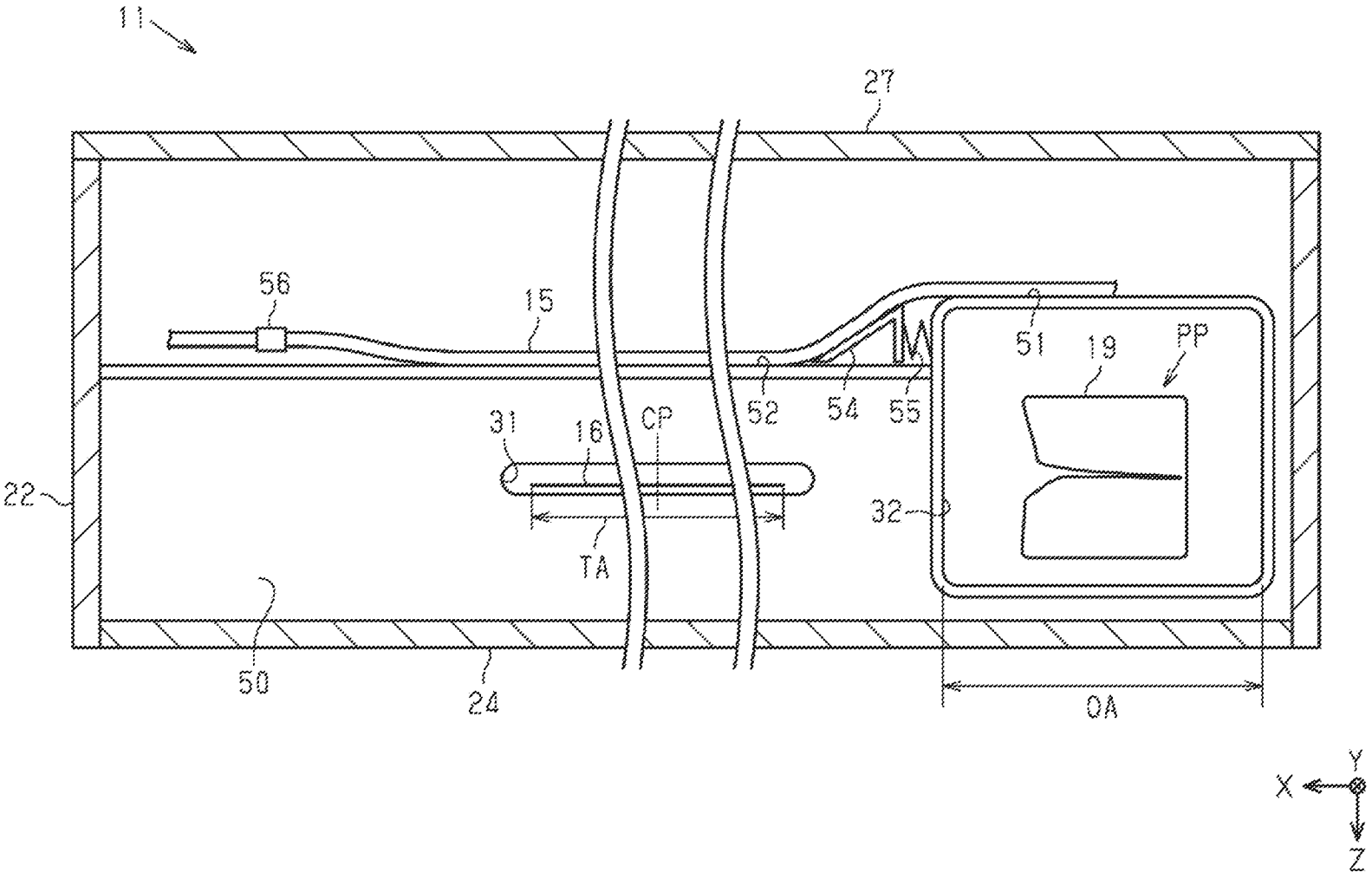
FIG. 3 is a schematic view illustrating an inner surface of a first exterior member.

As illustrated in FIG. 3, in the scanning direction X, an inclined surface part 54 may be provided between the first slide contact surface 51 and the second slide contact surface 52. The inclined surface part 54 may be provided to the first exterior member 21 in a detachable manner. When the inclined surface part 54 is formed of an elastic member such as rubber, the inclined surface part 54 absorbs an impact when the tube 15 collides with the inclined surface part 54 and hence, the risk of disturbance in behavior of the tube 15 can be reduced. When a portion of the inclined surface part 54 with which the tube 15 is brought into contact is formed in a plate shape, the inclined surface part 54 is easily deformed when the tube 15 collides with the inclined surface part 54. The printer 11 may be configured such that the printer 11 includes a spring 55 that pushes the inclined surface part 54 in a direction away from the first slide contact surface 51, and an impact when the tube 15 collides with the inclined surface part 54 is absorbed by the spring 55. The inclined surface part 54 is provided at a step between the first slide contact surface 51 and the second slide contact surface 52, and has an inclined surface that is gradually lowered in the scanning direction X from the first slide contact surface 51 toward the second slide contact surface 52. The inclined surface part 54 couples the first slide contact surface 51 and the second slide contact surface 52 to each other with a gentle gradient.

The first slide contact surface 51 is positioned in an opening region OA where the opening 32 is formed in the scanning direction X and in a region above the opening 32 in the vertical direction. The second slide contact surface 52 is positioned in a transport region TA where the medium 16 is transported in the scanning direction X and in a region below the first slide contact surface 51 in the vertical direction. The second slide contact surface 52 is positioned between the first slide contact surface 51 and the discharge port 31 in the vertical direction. The transport region TA is a region where the medium 16 having a maximum size printable by the printer 11 is transported and that is narrower than a region where the discharge port 31 is formed in the scanning direction X.

The tube 15 is fixed to the first exterior member 21 by a fixing member 56 in a region on a side farther from the opening 32 than the center CP of the transport region TA in the scanning direction X and in a region above the second slide contact surface 52 in the vertical direction. The fixing member 56 may be configured to fix the tube 15 in a region on a side farther from the opening 32 than the center CP of the transport region TA in the transport region TA, or may be configured to fix the tube 15 in a region on a side farther from the opening 32 than the transport region TA outside the transport region TA.

In the tube 15, a portion on a carriage 18 side with respect to a portion fixed by the fixing member 56 is deformed along with the movement of the carriage 18. A portion of the deformed portion of the tube 15 is brought into slide contact with the first slide contact surface 51. The tube 15 is configured such that a portion of the deformed portion positioned between the portion that is brought into contact with the first slide contact surface 51 and the portion fixed by the fixing member 56 is brought into slide contact with the second slide contact surface 52.

Next, the carriage coupling portion 44 and the cutter coupling portion 47 according to one embodiment are described.

Figure 4:
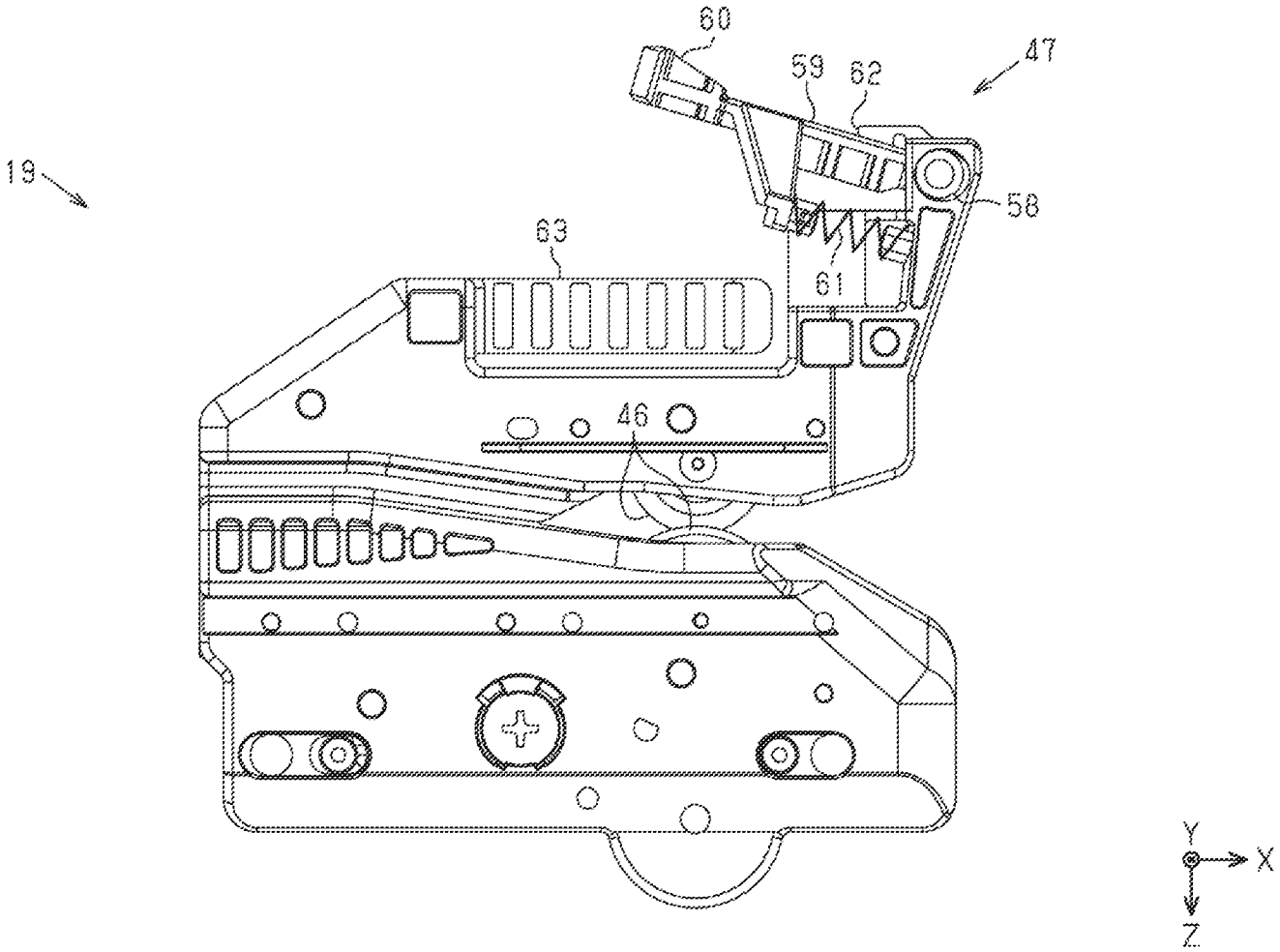
FIG. 4 is a front view of a cutter.

As illustrated in FIG. 4, the cutter coupling portion 47 includes a lever 59 that is swingable about a joint 58, and an engaging pawl 60 formed on a distal end of the lever 59. The cutter coupling portion 47 includes a pressing member 61 that pushes the lever 59 rearward and vertically upward, and a defining portion 62 that defines a swingable range of the lever 59 in the vertically upward direction. When a force against a pushing force of the pressing member 61 is applied to the lever 59, the lever 59 rotates so as to move the engaging pawl 60 forward and vertically downward. The cutter coupling portion 47 includes a plate-like protruding member 63 that protrudes in the scanning direction X. The protruding member 63 is positioned below the lever 59 in the vertical direction.

Figure 5:
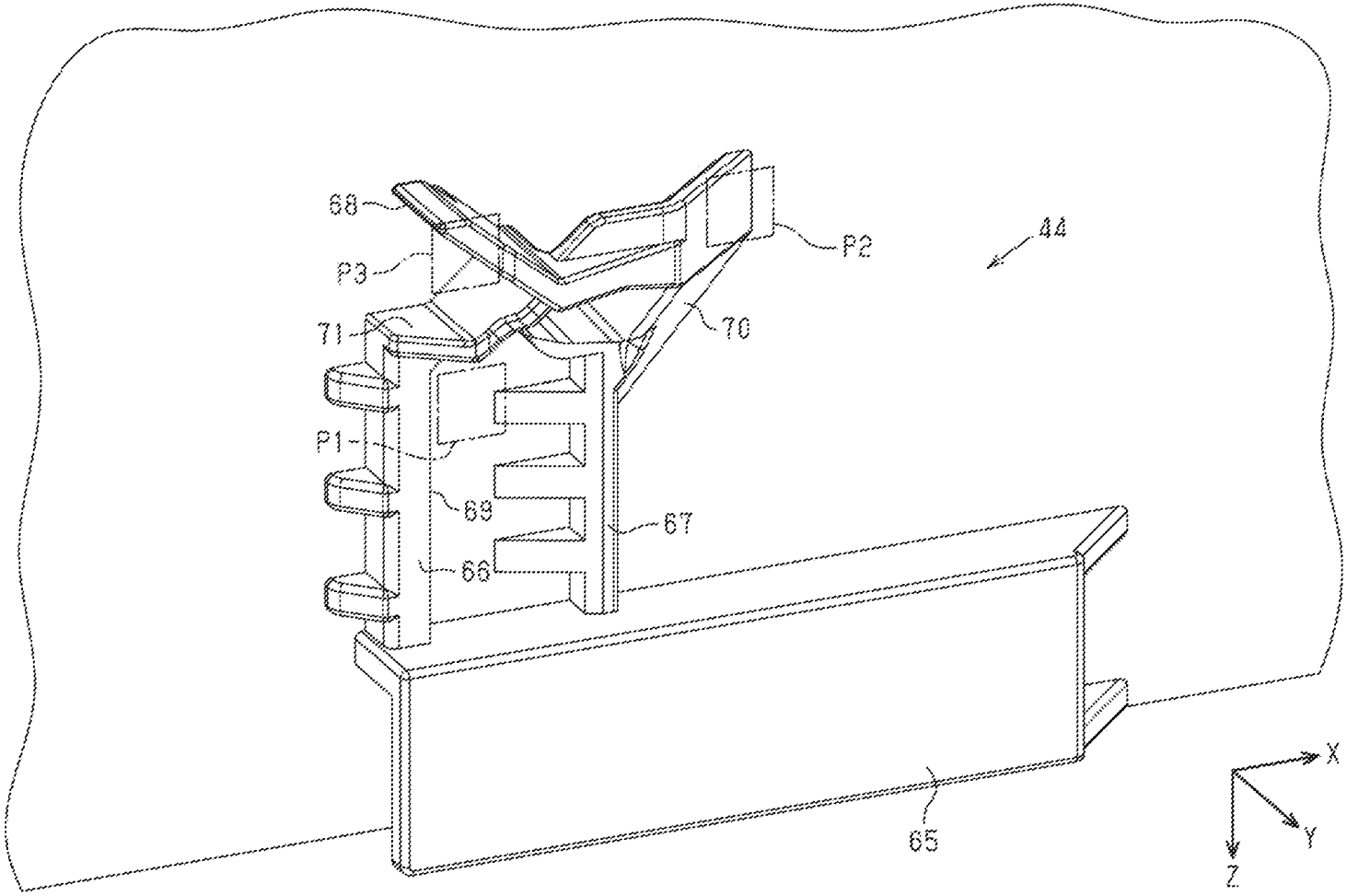
FIG. 5 is a perspective view of a carriage coupling portion.

As illustrated in FIG. 5, the carriage coupling portion 44 includes a holder 65 capable of accommodating the protruding member 63, a stopper rib 66 and a guide rib 67 extending in the vertically upward direction from the holder 65 respectively, and a guide member 68 positioned in front of the stopper rib 66 and the guide rib 67. The carriage coupling portion 44 includes a stopper surface 69 that is a side surface of the stopper rib 66 on a scanning direction X side, a guide surface 70 that is positioned on the scanning direction X side with respect to the stopper rib 66 and couples the guide rib 67 and the guide member 68 to each other, and a stopper wall 71 formed on an upper end of the stopper rib 66. The guide member 68 extends in a direction opposite to the scanning direction X from the guide surface 70. The stopper wall 71 couples the stopper rib 66 and the guide member 68 to each other.

The manner of operation of the present embodiment is described.

Figure 6:
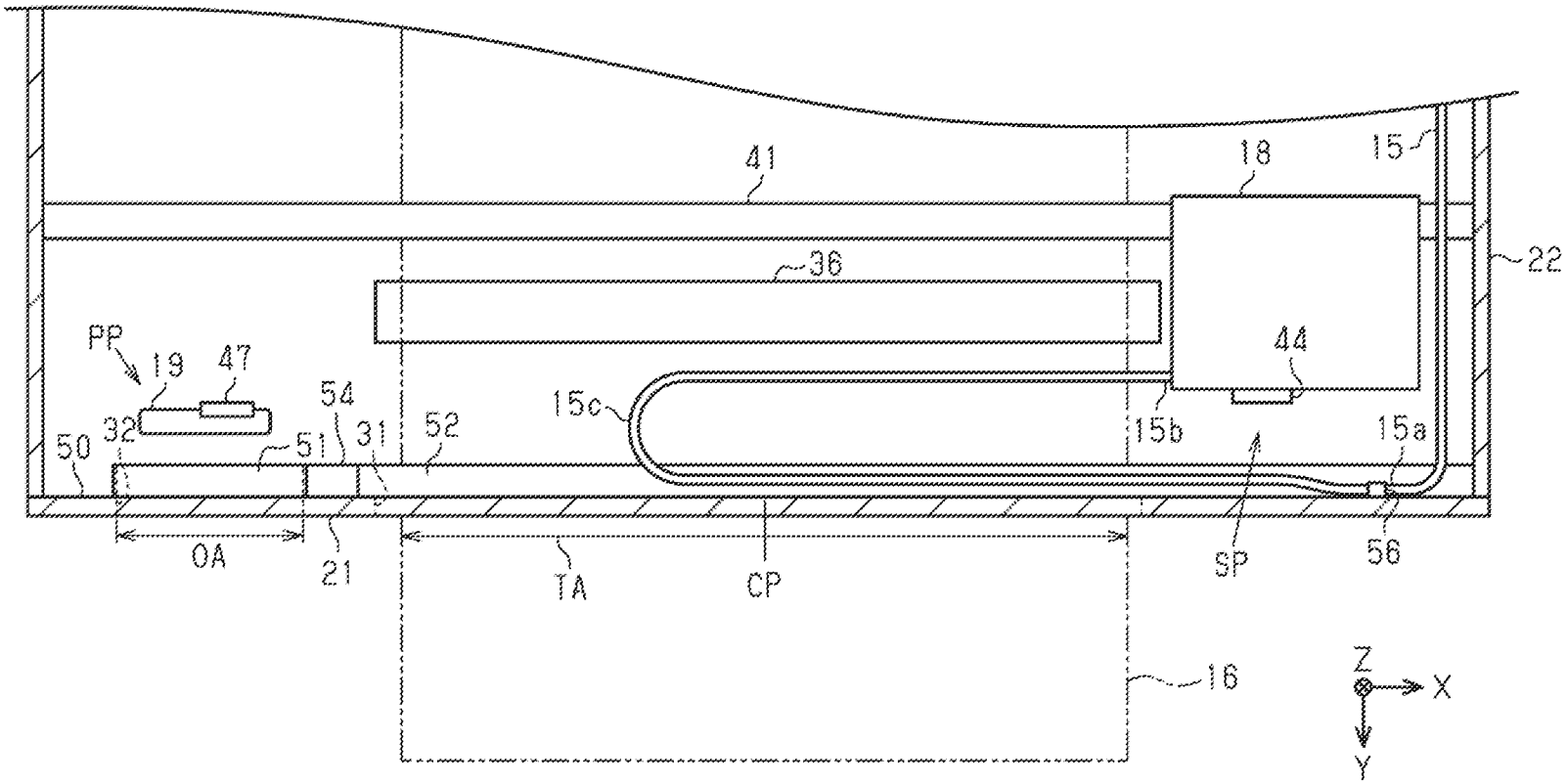
FIG. 6 is a schematic plan view illustrating a carriage at a standby position and a cutter at a predetermined position.

As illustrated in FIG. 6, when the carriage 18 is positioned at the standby position SP, with respect to the tube 15, a non-deformed portion 15*a* fixed to the fixing member 56 and a coupling portion 15*b* coupled to the second ink storage unit 14 are positioned remote from the opening 32 than the center CP of the transport region TA. In the tube 15, a curved portion 15*c* between the non-deformed portion 15*a* and the coupling portion 15*b* is positioned closer to the opening 32 than the center CP of the transport region TA.

The carriage 18 performs printing on the medium 16 by moving in the scanning direction X and in the direction opposite to the scanning direction alternately. Although a moving range of the carriage 18 at the time of printing is narrower than a moving range of the carriage 18 at the time of cutting the medium 16, a behavior of the tube 15 at the time of printing is substantially the same as a behavior of the tube 15 at the time of cutting the medium 16. Accordingly, a description with respect to an operation at the time of printing is omitted, and an operation at the time of cutting after the printing is finished is described.

Figure 7:
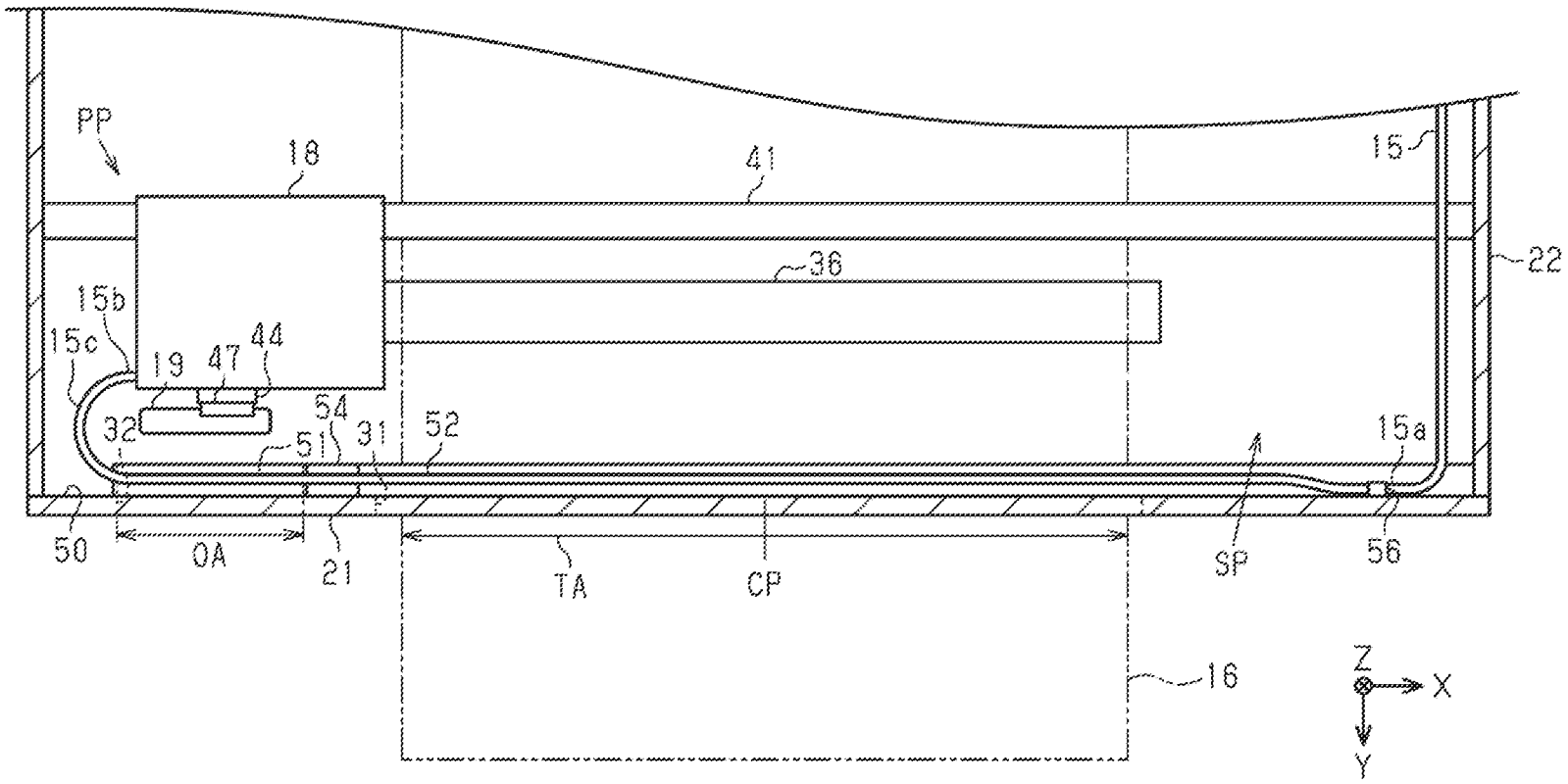
FIG. 7 is a schematic plan view illustrating the carriage and the cutter at the predetermined position.

As illustrated in FIG. 7, at the time of cutting the medium 16, the control unit 48 moves the carriage 18 positioned at the standby position SP in the direction opposite to the scanning direction X. When the carriage 18 moves in the direction opposite to the scanning direction X, the tube 15 is deformed such that a position of the curved portion 15*c* is changed. The tube 15 is brought into slide contact with the second slide contact surface 52, and is brought into slide contact with the first slide contact surface 51 so as to ride over the inclined surface part 54 and the first slide contact surface 51. When the carriage 18 moves to the predetermined position PP, the carriage coupling portion 44 and the cutter coupling portion 47 are coupled to each other.

Specifically, as illustrated in FIG. 4 and FIG. 5, the engaging pawl 60 is pushed downward in the vertical direction by the guide member 68 moving in the direction opposite to the scanning direction X, and is pushed forward by the stopper wall 71. The engaging pawl 60 allows the movement of the carriage coupling portion 44 by rotating. The control unit 48 stops the movement of the carriage 18 at a position where the stopper rib 66 passes through the engaging pawl 60. With such an operation, the engaging pawl 60 rides over the stopper rib 66. Then, the protruding member 63 is inserted into the holder 65.

Subsequently, the control unit 48 moves the carriage 18 positioned at the predetermined position PP in the scanning direction X. When the carriage 18 moves in the scanning direction X, the engaging pawl 60 is positioned at a first position P1 indicated by a chain line in FIG. 5. The first position P1 is a position where the engaging pawl 60 is brought into contact with the stopper surface 69. The carriage 18 moves the cutter 19 in the scanning direction X by pushing the engaging pawl 60 positioned at the first position P1 by the stopper surface 69. That is, along with the movement of the carriage 18 in a state where the cutter 19 and the carriage 18 are coupled to each other, the cutter 19 moves between the carriage 18 and the first exterior member 21. The cutter 19 cuts the medium 16 by moving in the scanning direction X.

Figure 8:
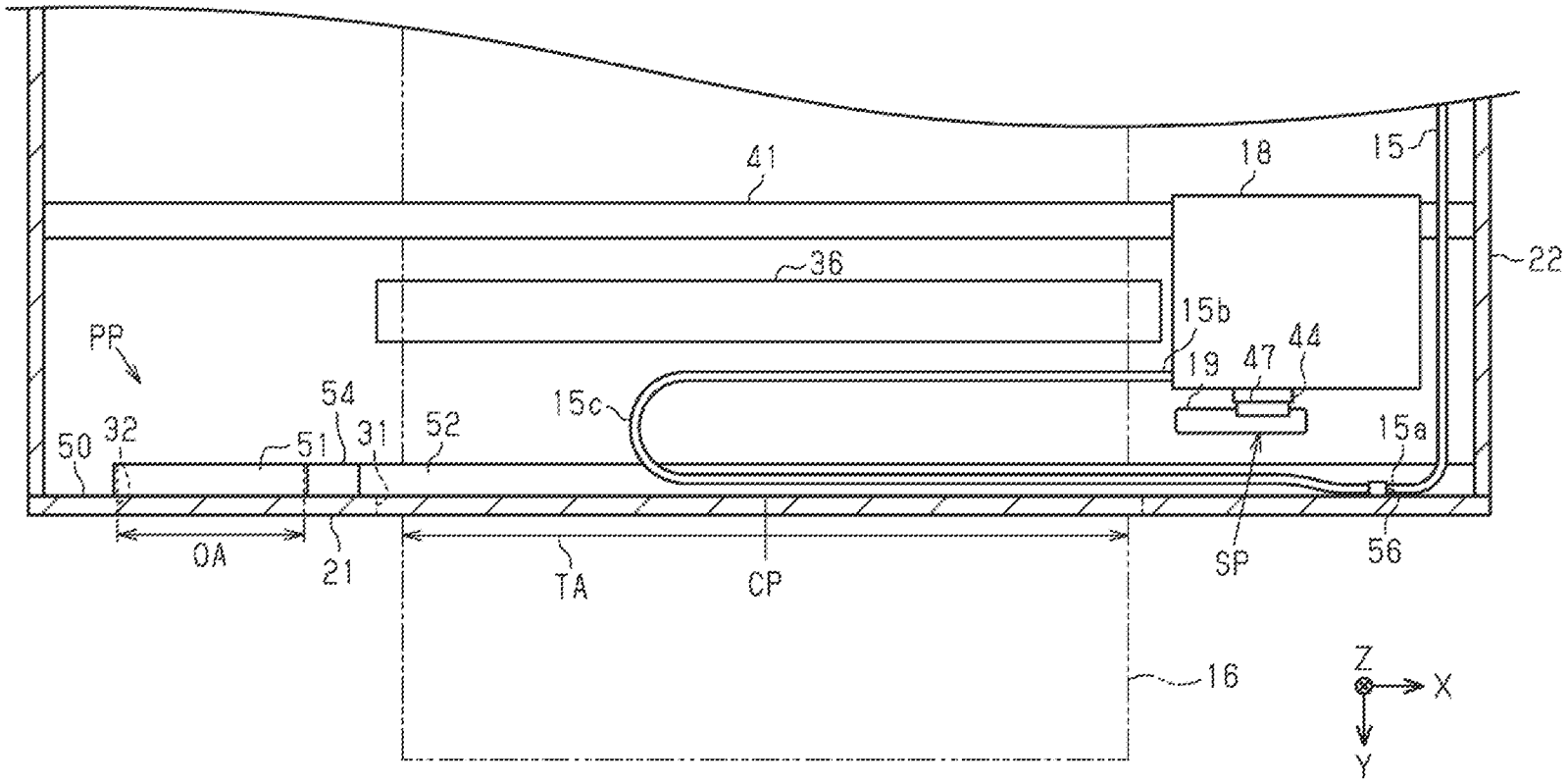
FIG. 8 is a schematic plan view illustrating the carriage and the cutter at the standby position.

As illustrated in FIG. 8, along with the movement of the carriage 18 in the scanning direction X, the tube 15 is separated from the first slide contact surface 51, the inclined surface part 54, and the second slide contact surface 52. The control unit 48 moves the carriage 18 and the cutter 19 in the direction opposite to the scanning direction X after temporarily stopping the carriage 18 and the cutter 19 at the standby position SP.

As illustrated in FIG. 4 and FIG. 5, the engaging pawl 60 positioned at the first positions P1 is pushed forward by the guide rib 67 that moves in the direction opposite to the scanning direction X. The engaging pawl 60 allows the movement of the guide rib 67 by rotating frontward. The engaging pawl 60 riding over the guide rib 67 is guided by the guide surface 70 and is positioned at a second position P2 indicated by a chain line in FIG. 5. In a state where the engaging pawl 60 is positioned at the second position P2, the holder 65 of the carriage 18 pushes the protruding member 63 in the direction opposite to the scanning direction X. Accordingly, the cutter 19 moves in the direction opposite to the scanning direction X together with the carriage 18, and returns to the predetermined position PP.

When the carriage 18 and the cutter 19 move to the predetermined position PP, the control unit 48 moves the carriage 18 in the scanning direction X again. The engaging pawl 60 positioned at the second position P2 is guided forward by the guide member 68, and the engaging pawl 60 avoids the stopper rib 66 by passing through a third position P3 indicated by a chain line in FIG. 5. The coupling between the carriage coupling portion 44 and the cutter coupling portion 47 is released. The cutter 19 stays at the predetermined position PP, and the carriage 18 returns to the standby position SP by moving in the scanning direction X.

Advantageous effects of the present embodiment is described.

(1) The inner surface 50 of the first exterior member 21 includes the first slide contact surface 51 that is positioned in the region above the opening 32 in the vertical direction in the opening region OA. The tube 15 capable of being brought into slide contact with the first slide contact surface 51 is supported by the first exterior member 21 at a position above the opening 32 in the vertical direction and hence, the possibility that the tube 15 is positioned between the opening 32 and the cutter 19 can be reduced whereby the visibility of the cutter 19 can be ensured.

(2) The inner surface 50 of the first exterior member 21 includes the second slide contact surface 52 that is positioned in the region below the first slide contact surface 51 in the vertical direction in the transport region TA. In the tube 15 capable of being brought into slide contact with the first slide contact surface 51 and the second slide contact surface 52, the portion of the tube 15 supported by the second slide contact surface 52 is positioned below the portion of the tube 15 supported by the first slide contact surface 51 in the vertical direction. Accordingly, a size of the transport region TA in the vertical direction can be reduced compared to a case where the tube 15 is supported at the same position as the first slide contact surface 51 in the vertical direction also in the transport region TA.

(3) The tube 15 coupled to the second ink storage unit 14 mounted on the carriage 18 is curved at a position remote from the carriage 18 and is supported by the inner surface 50 of the first exterior member 21 and hence, the curved portion 15*c* where the tube 15 is curved is not supported. In this respect, the cutter 19 positioned between the carriage 18 and the first exterior member 21 moves along with the movement of the carriage 18 in a state where the cutter 19 is coupled with the carriage 18. That is, the curved portion 15*c* of the tube 15 and the cutter 19 can be separated from each other in the scanning direction X and hence, it is possible to make the cutter 19 and the tube 15 minimally interfere with each other.

(4) The first slide contact surface 51 and the second slide contact surface 52 that differ from each other in position in the vertical direction can be smoothly coupled to each other by the inclined surface part 54. Accordingly, it is possible to reduce the impact that the tube 15 and the carriage 18 receive when the tube 15 supported by the second slide contact surface 52 rides over the first slide contact surface 51.

(5) The inclined surface part 54 is attachable to and detachable from the first exterior member 21. Accordingly, when the inclined surface part 54 is worn or the like, the inclined surface part 54 can be easily exchanged.

(6) When the carriage 18 moves the second ink storage unit 14 in the scanning direction X and in the direction opposite to the scanning direction X, in the tube 15, the deformed portion where the tube 15 is deformed and the non-deformed portion 15*a* where the tube 15 is not deformed are formed on the tube 15 along with the movement of the carriage 18. Accordingly, by fixing the non-deformed portion 15*a* of the tube 15 to the first exterior member 21 in the region on a side remote from the opening 32 and in the region above the second slide contact surface 52 in the vertical direction, the deformed portion can be easily brought into slide contact with the first slide contact surface 51 and the second slide contact surface 52.

The present embodiment can be also implemented by modifying as follows. The present embodiment and modified examples thereof described hereinafter may be implemented in combination as long as there is no technical contradiction.

The fixing member 56 may be configured, in a state where the carriage 18 is positioned at the standby position SP, to fix a portion of the tube 15 on a first ink storage unit 13 side with respect to the curved portion 15*c* to the first exterior member 21. The tube 15 may not be brought into slide contact with the second slide contact surface 52. The fixing member 56 may be configured to fix the tube 15 to the first exterior member 21 in a state where the tube 15 is brought into contact with a surface coplanar with the second slide contact surface 52. In the printer 11, the tube 15 may not be fixed to the first exterior member 21.

The inclined surface part 54 may be fixed to the first exterior member 21.

An inclined surface between the first slide contact surface 51 and the second slide contact surface 52 may be formed integrally with the first exterior member 21.

The printer 11 may separately include a mechanism for moving the carriage 18 and a mechanism for moving the cutter 19.

The second slide contact surface 52 may be positioned in a region above the first slide contact surface 51 in the vertical direction. The second slide contact surface 52 may be positioned at the same position as the first slide contact surface 51 in the vertical direction.

Hereinafter, technical concepts and advantageous effects thereof that are understood from the above-described embodiment and modified examples are described.

(A) The printer includes: the first ink storage unit configured to store ink, the second ink storage unit configured to store the ink supplied from the first ink storage unit, the ejection head configured to eject the ink toward the medium, the carriage configured to move the ejection head and the second ink storage unit in the scanning direction and the direction opposite to the scanning direction, the tube coupling the first ink storage unit and the second ink storage unit to each other, the exterior member positioned in front of the carriage, and the cutter configured to move in the scanning direction between the carriage and the exterior member to cut the medium, wherein the opening is formed in the exterior member at a position in front of the cutter disposed at the predetermined position, the inner surface of the exterior member includes the first slide contact surface configured to be slidably contacted by the tube, and the first slide contact surface is positioned in the opening region where the opening is formed in the scanning direction and in the region above the opening in the vertical direction.

According to such a configuration, the inner surface of the exterior member includes the first slide contact surface positioned in the region above the opening in the vertical direction in the opening region. The tube capable of being brought into slide contact with the first slide contact surface is supported by the exterior member at the position above the opening in the vertical direction and hence, the possibility that the tube is positioned between the opening and the cutter can be reduced whereby the visibility of the cutter can be ensured.

(B) In the printer, the inner surface of the exterior member includes the second slide contact surface with which the tube can be brought into slide contact, and the second slide contact surface may be positioned in the transport region where the medium is transported in the scanning direction, and in a region below the first slide contact surface in the vertical direction.

According to such a configuration, the inner surface of the exterior member includes the second slide contact surface positioned in the region below the first slide contact surface in the vertical direction in the transport region. In the tube capable of being brought into slide contact with the first slide contact surface and the second slide contact surface, the portion of the tube supported by the second slide contact surface is positioned below the portion of the tube supported by the first slide contact surface in the vertical direction. Accordingly, the size of the transport region in the vertical direction can be reduced compared to a case where the tube is supported at the same position as the first slide contact surface in the vertical direction also in the transport region.

(C) The printer may be configured such that the cutter moves along with the movement of the carriage in a state where the cutter and the carriage are coupled to each other.

The tube coupled to the second ink storage unit mounted on the carriage is curved at a position remote from the carriage and is supported by the inner surface of the exterior member and hence, the curved portion where the tube is curved is not supported. In this respect, with such a configuration, the cutter positioned between the carriage and the exterior member moves along with the movement of the carriage in a state where the cutter is coupled with the carriage. That is, the curved portion of the tube and the cutter can be separated from each other in the scanning direction and hence, it is possible to make the cutter and the tube minimally interfere with each other.

(D) In the printer, in the scanning direction X, the inclined surface part may be provided between the first slide contact surface and the second slide contact surface.

According to such a configuration, the first slide contact surface and the second slide contact surface that differ from each other in position in the vertical direction can be smoothly coupled to each other by the inclined surface part. Accordingly, it is possible to reduce the impact that the tube and the carriage receive when the tube supported by the second slide contact surface rides over the first slide contact surface.

(E) In the printer, the inclined surface part may be attachable to and detachable from the exterior member.

According to such a configuration, the inclined surface part is attachable to and detachable from the exterior member. Accordingly, when the inclined surface part is worn, the inclined surface part can be easily exchanged.

(F) In the printer, the tube may be fixed to the exterior member in a region on a side farther from the opening than the center of the transport region in the scanning direction and in a region above the second slide contact surface in the vertical direction.

When the carriage moves the second ink storage unit in the scanning direction and the direction opposite to the scanning direction, in the tube, a deformed portion that is deformed along with the movement of the carriage and a non-deformed portion where the tube is not deformed are generated. Accordingly, with such a configuration, by fixing the non-deformed portion of the tube to the exterior member in the region on a side remote from the opening and in a region above the second slide contact surface in the vertical direction, the deformed portion can be easily brought into slide contact with the first slide contact surface and the second slide contact surface.

REFERENCE SIGNS LIST

11 . . . PRINTER, 12 . . . CASE, 13 . . . FIRST INK STORAGE UNIT, 14 . . . SECOND INK STORAGE

UNIT, 15 . . . TUBE, 15*a* . . . NON-DEFORMED PORTION, 15*b* . . . COUPLING PORTION, 15*c* . . . CURVED PORTION, 16 . . . MEDIUM, 17 . . . EJECTION HEAD, 18 . . . CARRIAGE, 19 . . . CUTTER, 21 . . . FIRST EXTERIOR MEMBER, 22 . . . SECOND EXTERIOR MEMBER, 23 . . . THIRD EXTERIOR MEMBER, 24 . . . FOURTH EXTERIOR MEMBER, 26 . . . FRONT COVER, 27 . . . FIRST UPPER COVER, 28 . . . SECOND UPPER COVER, 29 . . . OPERATION PANEL, 31 . . . DISCHARGE PORT, 32 . . . OPENING, 34 . . . GUIDE MEMBER, 35 . . . TRANSPORT UNIT, 36 . . . SUPPORT STRUT, 37 . . . PAIR OF TRANSPORT ROLLERS, 38 . . . PAIR OF RELAY ROLLERS, 39 . . . PAIR OF DISCHARGE ROLLERS, 41 . . . GUIDE SHAFT, 42 . . . NOZZLE, 43 . . . NOZZLE SURFACE, 44 . . . CARRIAGE COUPLING PORTION, 46 . . . CUTTING BLADE, 47 . . . CUTTER COUPLING PORTION, 48 . . . CONTROL UNIT, 50 . . . INNER SURFACE, 51 . . . FIRST SLIDE CONTACT SURFACE, 52 . . . SECOND SLIDE CONTACT SURFACE, 54 . . . BEVEL PART, 55 . . . SPRING, 56 . . . FIXING MEMBER, 58 . . . JOINT, 59 . . . LEVER, 60 . . . ENGAGING PAWL, 61 . . . PRESSING MEMBER, 62 . . . DEFINING PORTION, 63 . . . PROTRUDING MEMBER, 65 . . . HOLDER, 66 . . . STOPPER RIB, 67 . . . GUIDE RIB, 68 . . . GUIDE MEMBER, 69 . . . STOPPER SURFACE, 70 . . . GUIDE SURFACE, 71 . . . STOPPER WALL, CP . . . CENTER, OA . . . OPENING REGION, P1 . . . FIRST POSITION, P2 . . . SECOND POSITION, P3 . . . THIRD POSITION, PP . . . PREDETERMINED POSITION, R . . . ROLL BODY, SP . . . STANDBY POSITION, TA . . . TRANSPORT REGION, X . . . SCANNING DIRECTION

The invention claimed is:

1. A printer comprising:

a first ink storage unit configured to store ink;

a second ink storage unit configured to store the ink supplied from the first ink storage unit;

an ejection head configured to eject the ink toward a medium;

a carriage configured to move the ejection head and the second ink storage unit in a scanning direction and a direction opposite to the scanning direction;

a tube coupling the first ink storage unit and the second ink storage unit to each other;

an exterior member positioned in front of the carriage; and a cutter configured to move in the scanning direction between the carriage and the exterior member to cut the medium, wherein in the exterior member, an opening is formed in front of the cutter disposed at a predetermined position, an inner surface of the exterior member includes a first slide contact surface configured to be slidably contacted by the tube, and the first slide contact surface is positioned in an opening region where the opening is formed in the scanning direction and in a region above the opening in a vertical direction.

2. The printer according to claim 1, wherein the inner surface of the exterior member includes a second slide contact surface configured to be slidably contacted by the tube, and the second slide contact surface is positioned in a transport region where the medium is transported in the scanning direction and in a region below the first slide contact surface in the vertical direction.

3. The printer according to claim 2, wherein the cutter is configured to move along with movement of the carriage in a state where the cutter and the carriage are coupled to each other.

4. The printer according to claim 2, wherein an inclined surface part is disposed between the first slide contact surface and the second slide contact surface in the scanning direction.

5. The printer according to claim 4, wherein the inclined surface part is attachable to and detachable from the exterior member.

6. The printer according to claim 2, wherein the tube is fixed to the exterior member in a region on a side farther from the opening than a center of the transport region is in the scanning direction and in a region above the second slide contact surface in the vertical direction.

* * * * *